US005328652A

United States Patent [19]

Thomson

[11] Patent Number: 5,328,652

[45] Date of Patent: Jul. 12, 1994

[54] METHOD FOR MAKING A FOAMED GOAL PAD FOR HOCKEY

[75] Inventor: Paul W. Thomson, Merion, Pa.

[73] Assignee: Protective Athletic Designs, Inc., Merion Station, Pa.

[21] Appl. No.: 901,079

[22] Filed: Jun. 19, 1992

[51] Int. Cl.[5] ..... B29C 67/22

[52] U.S. Cl. ..... 264/51; 264/328.7

[58] Field of Search ..... 2/22, 24, 23, 2.5, 267; 264/222, 223, DIG. 30, 46.9, 46.4, 46.5, 51, 328.7

[56] References Cited

U.S. PATENT DOCUMENTS

| | | | |
|---|---|---|---|
| 1,647,452 | 11/1927 | Knischewsky . | |
| 2,363,058 | 11/1944 | Gill . | |
| 3,048,169 | 8/1962 | Pierce | 264/222 |
| 3,377,416 | 4/1968 | Kandel | 264/223 |
| 3,403,676 | 10/1968 | Gibbons | 264/DIG. 30 |
| 3,405,506 | 10/1968 | Kostur | 264/222 |
| 3,446,880 | 5/1969 | Enicks | 264/DIG. 30 |
| 3,520,002 | 7/1970 | Wellington | 264/222 |
| 3,877,077 | 4/1975 | Chapdelaine . | |
| 3,936,075 | 2/1976 | Jelliffe . | |
| 4,292,263 | 9/1981 | Hanrahan et al. | 264/46.9 |
| 4,307,056 | 12/1981 | Meyer | 264/DIG. 30 |
| 4,370,754 | 2/1983 | Donzis . | |
| 4,608,718 | 9/1986 | Reed . | |
| 4,635,300 | 1/1987 | Rhee . | |
| 4,868,926 | 9/1989 | Lowson . | |
| 4,926,884 | 5/1990 | Lonardo . | |

FOREIGN PATENT DOCUMENTS

| | | | |
|---|---|---|---|
| 831375 | 1/1970 | Canada . | |
| 971302 | 7/1975 | Canada . | |
| 1011052 | 5/1977 | Canada . | |
| 3433005 | 3/1985 | Fed. Rep. of Germany . | |
| 367334 | 4/1930 | United Kingdom | 264/222 |
| 955486 | 4/1964 | United Kingdom . | |

*Primary Examiner*—Allan R. Kuhns

*Attorney, Agent, or Firm*—Lerner, David, Littenberg, Krumholz & Mentlik

[57] ABSTRACT

Protective leg gear for a hockey goalie includes a protective leg pad which is molded to be lightweight and include substantially anatomically matching rear portion with provisions for the knee, foot and ankle so that a break-in period is not required. A method of molding the leg pad for the protective leg gear includes a single molding process in which a mold is charged with a semi-flexible open cell urethane material which is permitted to cure.

8 Claims, 2 Drawing Sheets

METHOD FOR MAKING A FOAMED GOAL PAD FOR HOCKEY

BACKGROUND OF THE INVENTION

The present invention relates generally to protective leg gear and a method of making the same, especially adapted for sports participants such as hockey goalies or the like.

Protective leg gear, such as hockey goalie pads, provides crucial protection for the leg, ankle and foot by serving as a protective barrier between the goalie's leg and the outer environment or playing area. Such gear is generally adapted to absorb the impact from a high speed object such as an ice hockey puck or street hockey ball as well as protect the wearer from other potentially dangerous objects such as hockey sticks and skate blades that may come in contact with the goalie's legs. Leg protection is crucial for goalies and many manufacturers offer such protective equipment to both professional and amateur sports participants.

Even with the advent of new technology in the area of protective sports equipment, numerous disadvantages and shortcomings exist with currently available protective leg gear. Problems are found both in the overall design of the gear as well as in the manufacturing processes used to fabricate the protective equipment. Such disadvantages and shortcomings are particularly prevalent in protective gear of professional quality which is used at higher levels of competition, whether professional or amateur.

For example, at the design level, typical protective goalie pads have been made from stuffing various fill materials, such as deer hair, kapok, or polyester fiber, into certain specifically shaped pockets, which then are sewn closed. These filled pockets are then assembled together to form the leg gear to protect the wearer. The fill material is chosen to allow adequate impact absorption to provide protection against a puck or other impacts. One substantial shortcoming of these types of filled leg pads, especially the deer hair stuffed pads, is that the fill material after extended use and, over time, suffers significant breakdown. Namely, as time and wear progresses, the deer hair turns increasingly brittle and will break into smaller and smaller fragments leading to less than adequate shock absorption for the wearer. Also, kapok is quite expensive and generally unavailable.

In addition to unwanted breakdown, the fill material, particularly polyester, is often undesirably heavy and can unnecessarily weigh down the wearer of the pads. Thus, although these stuffed pads may adequately protect the wearer from the impact of a high speed hockey puck, at least before the fill material breaks down, such protection is provided at the expense of increased weight on the legs thereby hindering the agility and mobility of the goalie.

In addition to the weight problem of the typical stuffed protective pads, another shortcoming is that they generally do not matchingly conform to the contour of the wearer's legs and therefore must be sufficiently "broken-in" to provide adequate comfort to the wearer. Only after such pads are "broken-in" will the pad be less of a hindrance to the mobility of the goalie. Breaking in the pads is especially important at the ankle, and existing pads do not provide an adequate and appropriately shaped bend in the ankle area and thus must be repeatedly worn to provide a sharp enough and appropriately shaped bend to be comfortable to wear and not interfere with the goalie's mobility. Similarly, the knee area of existing pads is stiff and not contoured to the shape of the human knee. It too requires a break-in period before the pads are comfortable and do not hinder the goalie's movements. The process of breaking in the pads often takes numerous hours of wearing the pads which are often initially uncomfortable until fully broken-in to the satisfaction of the wearer. Further, during such a break-in period, the pad is subject to undue wear which limits the useful life of the pad.

The sports equipment industry has attempted to address mainly the weight problem of usual stuffed protective pads by using synthetic foam cushioning materials to provide the requisite padding and protection. Although such foam pads are lighter than their stuffed counterparts, they too suffer from the problem of requiring a break-in period in order to achieve a sufficient comfort level to the wearer. Again, adequate break-in is necessary due to the fact that the foam provided around the leg of the wearer, typically in the form of a smooth and straight groove, does not correspondingly match the contours of a human leg, especially in the ankle and knee areas.

In addition, the foam cushioning materials used in existing pads do not exhibit the most desirable "flex" characteristics. For instance, it is often necessary for goalies to come close to doing a "split" so that one leg rests on the ice from the knee to the toe (the other leg rests on the ice from the back of the knee to the heel). The toe of the skate is pointed back so that the point of the toe aligns with the plane of the shin and knee. This requires the pad to flex in a reverse direction from the direction it must flex when the goalie bends his knee. Existing pads are made of foam cushioning materials which do not readily flex in both directions.

Furthermore, in addition to the aforementioned design difficulties other problems also exist at the assembly stage which unnecessarily add to increased manufacturing costs. For example, with the typical stuffed pads, it is often time-consuming and labor-intensive to first hand stuff and then close up each individual pocket which ultimately forms the protective pad. These increased manufacturing costs to the producer are usually passed on to the customer in the form of higher priced protective leg gear.

Even with the increased use of synthetic foam instead of other fill materials, many manufacturing processes are still unnecessarily labor intensive in that the foam must be cut and shaped into individual sections, typically four or five pieces, that are then hinged together to form the full pads. Such angling, cutting and hinging of the foam is necessary to achieve a better fit, but also increases manufacturing costs by also being both labor-intensive and time-consuming.

German Offenlegungsschrift 3,433,005 discloses a leg protector and method for making the same, most likely for street hockey and not a high level goal pad for ice hockey, whereby the leg protector is made from two continuous laminated foam layers (4, 5), whereby the density of the outer foam material (4) of the cushion material is substantially less than that of the inner foam material layer (5), as well as a cushioning material (10). The disclosure relates primarily to the formation of the continuous laminated layers. The cushioning material (10) of the body protector is shown as being made up of three separate longitudinal pieces of material. Applicant herein believes that the cushioning portion (10) of the body protector in this reference is made up of a foam material which is at least partially cut by hand, if not entirely cut by hand. Consistent with this belief, the reference shows three separate pieces which make up the back portion of the body protector. Instead of cutting out the hollow for the leg, it would be easier to cut three separate pieces into the shapes shown and attach them as shown in the reference. Thus, although this reference appears to be directed to decreasing manual labor and costs, its efforts in this regard focus on the continuous laminated protective portion in the front of the body protector. The construction of the rear portion of the body protector still results in high manufacturing costs in view of the manual labor involved. The pad shown in this reference does not have a bent portion for the thigh, a knee area or a relatively sharp angle at the ankle area.

Some high level goal pads which are available for ice hockey are laboriously cut and shaped from foam and have outer materials which are designed to accept a sharp angle at the ankle after a break-in period. None are designed to have a structure which requires no break-in period, but rather provides at the outset a superior-fitting pad in the area of the ankle (as well as in the area of the knee).

Accordingly, existing protective leg gear, whether commercialized or simply described in a patent reference, has suffered from the significant shortcomings explained above. To summarize, leg gear is either too heavy, requires an extensive break-in period, or is costly to manufacture. Thus, there is a great and a long felt need to solve these aforementioned problems by providing light-weight leg gear which does not require an extensive break-in period as required by existing pads. Such leg gear should be manufactured and assembled in a manner that takes fewer steps, or at least less involved steps, to result in a lower cost for both the manufacturer and ultimately the consumer.

SUMMARY OF THE INVENTION

The present invention specifically relates to a protective leg pad for protective leg gear, the leg pad having a leg portion with an elongate leg groove which substantially anatomically matches and is coextensive with the contour of the front and sides of the human leg from the knee to the ankle and foot area, an ankle and foot portion integral with the leg portion and provided to cover the ankle area and at least a portion of the foot area of the human leg, the ankle and foot portion having an ankle groove, the leg portion and the ankle and foot portion having been integrally molded in a single mold such that the ankle groove of the ankle and foot portion is coextensive with the leg groove.

The protective leg pad in accordance with the present invention may include a recessed knee area to receive the knee of the human leg and to thereby avoid the need to break in the leg pad. Also in accordance with the present invention, the integral ankle and foot portion can be arranged so that it extends away from the leg groove at a relatively sharp angle with respect to the leg portion to also avoid the need to break-in the leg pad. The leg portion may be adapted to cover only a small portion of the thigh just above the knee, and the leg portion may have a slight bend towards the leg groove just above the knee so as to accommodate the usual bent stance of a goalie. In this manner, when the goalie is in his stance in front of the goal, his normally bent knees will not adversely affect the covering of the leg on the small portion of the thigh just above the knee.

The protective leg pad can be made as part of a protective leg gear which includes outer padding, the various portions of which are separately molded pieces, a rigid intermediate leg member to cover the leg and knee areas and a rigid intermediate ankle and foot portion to cover the ankle and foot areas. The rigid members are disposed between the outer padding and the protective leg pad.

A method for making a protective leg pad includes the steps of providing a mold, charging the mold with a synthetic foam material, allowing the material to at least partially cure in the mold and removing the at least partially cured material from the mold. Preferably, the synthetic foam material is heat curable and the method further includes the step of at least partially cooling the material in the mold.

Further, the mold provided in accordance with the method may include a knee ridge raised above the semicylindrical raised ridge so as to form in the protective leg pad an area for the knee of a human leg. In addition, the mold preferably further comprises an ankle and foot ridge constructed and arranged to form a protective leg pad having an ankle and foot portion which is at a relatively sharp angle with respect to the leg portion, the ankle and foot portion being integral with the leg portion and having an ankle groove coextensive with the leg groove for receiving the ankle and at least a portion of the foot. The mold may further comprise a bend portion constructed and arranged to form a protective leg pad having a slight bend towards the leg groove above the knee of a human leg.

The method may also include the step of forming slots in the leg portion of the leg pad for receiving straps and may include the step of inserting slot-forming rod members into the mold and through the synthetic material so as to form strap receiving slots in the leg portion of the leg pad. The method may also include the step of heating the mold prior to charging the mold with the synthetic foam material.

It is an object of the present invention to provide a molded leg pad which is light in weight, easy and inexpensive to manufacture, and does not require a break-in, and a method for making same.

It is also an object of the present invention to provide protective leg gear being made of a leg pad molded in a single step, rigid intermediate members for providing additional protection and outer padding made up of several pieces, each of which is formed and contoured in a single molding step prior to attachment to the leg pad.

The present invention provides an article and a method which can provide reproducible results with consistent shape and structure such that no break-in period is required for the ankle and knee regions of the goal pad. The article and method are inexpensive from a manufacturing standpoint and do not rely on skilled craftsmanship to provide the reproducible and consistent result.

BRIEF DESCRIPTION OF THE DRAWINGS

The foregoing and other objects of the present invention will become apparent as will a better concept underlying the present invention, by reference to the description which follows and refers to the accompanying drawings in which.

DETAILED DESCRIPTION OF A PREFERRED EMBODIMENT

In the detailed description that follows, the features of the present invention will be described as applied to protective leg gear for only one leg. It should be appreciated, however, that a typical sports participant such as a hockey goalie would wear protective leg gear on both legs for full protection. It should be further appreciated that although the present invention will be described as applied generally to leg gear for a hockey goalie, various features of the present invention may be readily adapted to and incorporated in other forms of protective equipment, such as arm pads, shoulder pads, and other such protective gear either for sports or other activities such as housework, yardwork, and the like.

Figure 2:
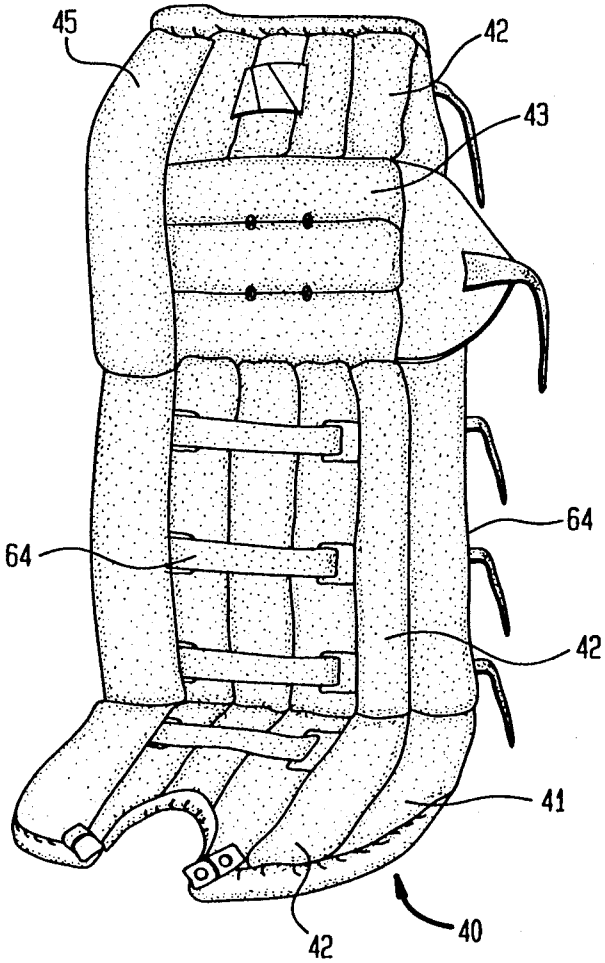
FIG. 2 is a front perspective view of the fully assembled protective leg gear.
Figure 1:
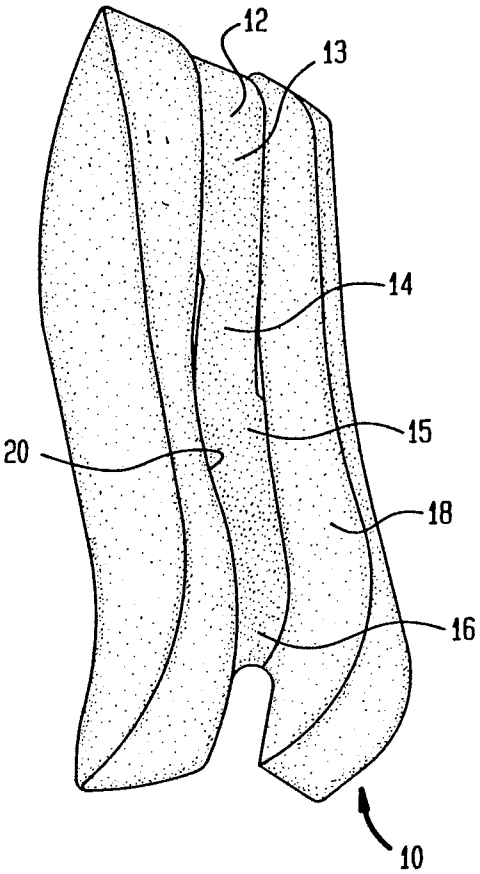
FIG. 1 is a rear perspective view of the inner pad member of the protective leg gear in accordance with the present invention.

Referring to FIGS. 1 and 2, there is illustrated a preferred embodiment of the protective molded leg pad, generally designated as 10, which is used in the construction of the fully assembled protective leg gear to be described herein, generally designated as 40, for use by a hockey goalie. As shown in FIG. 1, molded leg pad 10 is uniquely molded to form a single integral piece. The molded material is preferably a slow recovery, shock absorbent, semi-flexible, open cell urethane foam which is to be extremely light in weight, so as not to impede the goalie's quickness and agility. Such a foam material used for molded leg pad 10 has the advantage of allowing the full leg gear 40 to weigh as little as approximately five pounds, in contrast to other stuffed leg gear weighing up to twice as much. Further, such a foam material is also utilized for its superior characteristics of durability and ability to retain its form over extensive use.

Molded leg pad 10 includes an elongate groove 12 and adjacent side walls 18 and 20 which substantially anatomically match and are coextensive with the contour of the front and sides of a human leg. Elongate groove 12 and adjacent side walls 18 and 20 are formed accordingly such that they correspond with specific areas and portions of a human leg. The convex contour for these areas (12, 16, 18 and 20) facilitates the provision of a more form-fitting pad, as the convex contour permits the pad to conform and fit tightly with the shape of an individual leg when the straps of the protective gear are tightened. This allows the gear to attain a more unitary arrangement with the leg.

Molded leg pad 10 further includes thigh area 13 rising a short distance above the knee, knee area 14, shin area 15, and ankle and foot area 16. Each of such corresponding areas 13, 14, 15, and 16 are continuous and are molded in a single mold to substantially anatomically match the respective areas of a human leg. Such anatomical matching, achieved through the molding method of the present invention as described below, allows for increased comfort for the wearer because protective leg gear 40, which incorporates molded leg pad 10, can more easily and less expensively match the contours of the wearer's leg than other non-molded leg gear without sacrificing durability. Furthermore and significantly, such anatomical molding substantially eliminates the need for the wearer to "break-in" leg gear 40 through extended wear. The molding of the pad permits reproducible manufacturing results for variously contoured areas.

The ankle and foot area 16 of molded leg pad 10 is particularly contoured and formed to closely approximate the shape and contour of the ankle and foot, and also to accommodate the movement of the ankle and foot during play and to essentially eliminate the need to break-in the ankle and foot area. The integral formation of the ankle and foot area 16 from one side of the molded leg pad 10 to the other provides for greater comfort and a better fit. As can be appreciated, the prior methods of either separate formation of the ankle and foot area or partial integral formation of the ankle and foot area provide more of a chance for error and misalignment in constructing the goalie pad, as well as additional manufacturing costs. Further, cutting pieces of foam is too labor-intensive for manufacturing pads on a commercial basis.

Figure 5:
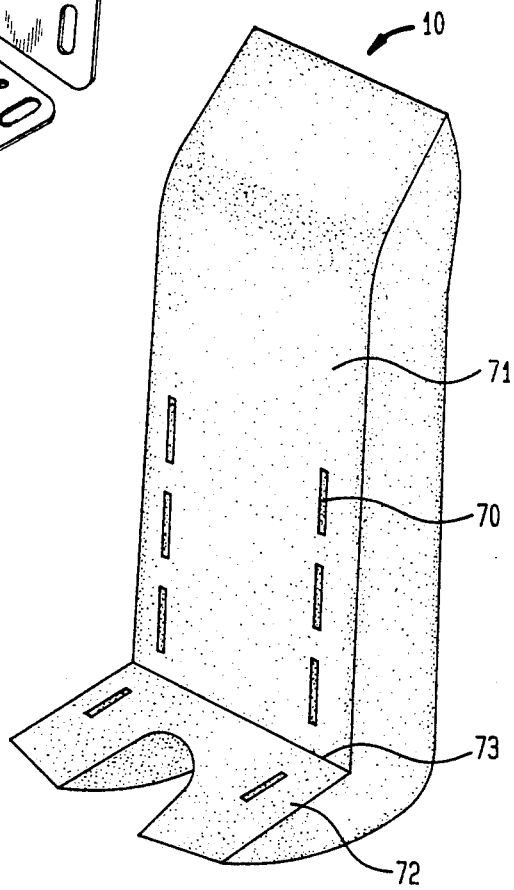
FIG. 5 is a front perspective view of the inner pad member of the protective leg gear depicted in FIG. 1.

The ankle and foot area is molded with the remaining areas of the pad such that the ankle and foot area is at a sharp angle to the leg portion of the pad. More specifically, and consistent with the preferred embodiment, the rear portion of the leg portion is preferably at approximately 90° from the bottom portion of the ankle and foot area, as best shown in FIG. 5. Other angles in this area are also contemplated, though the angle must be such that the pad in the ankle and foot area do not require breaking in. As another point of reference, it is preferable that the angle between surface 71 and 72 (as joined at 73) be approximately 110°, or in the range of 90° to 120°.

Knee area 14 of molded leg pad 10 is also particularly contoured and formed to closely approximate the shape and contour of a human knee. This is important because the knee generally protrudes slightly from the leg and thus with typical non-molded leg gear, this area normally requires additional breaking in to accommodate the knee and the movement of the knee. The instant invention, however, addresses this concern by assuring that there is sufficient room for the knee in knee area 14 within elongate groove 12 to essentially eliminate the need to break-in the knee area.

The molding process used to form molded leg pad 10 is unique in the area of protective goalie padding. To provide superior form fitting to the actual contours of a human leg, and thereby practically eliminate the need for a break-in period, a mold is provided that substantially anatomically approximates a human leg. In a preferred method of forming molded leg pad 10, the mold is then charged with a foam material (in liquid or substantially liquid form) such as a slow recovery, shock absorbent, semi-flexible open cell urethane foam, and heated and agitated if necessary for curing, until leg pad 10 is fully formed, and then removed. An example of such a foam material is Kern Hygard shock absorbent urethane foam available from Kern Foam Products Corp. in South Plainfield, N.J. Hygard foam is a 5 lb./cu. ft. foam which is available in liquid form. It is prepared by mixing other liquid components with the liquid and agitating the mixture slowly (while heating). However, it should be appreciated that many methods of molding and charging such molds can be adapted to form molded leg pad 10 as described herein.

Figure 3:
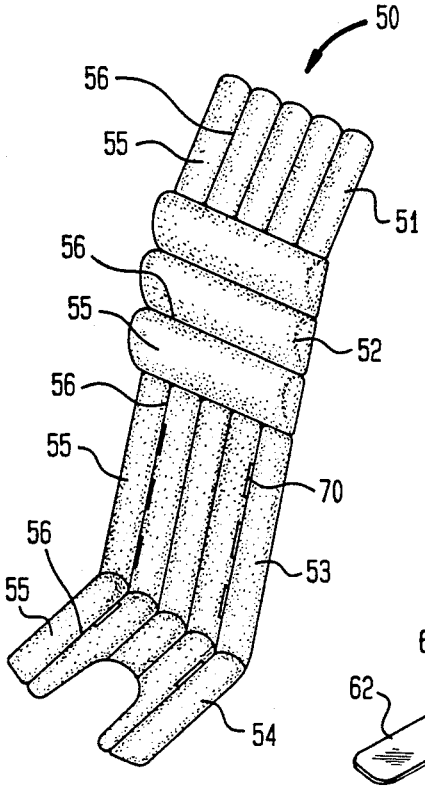
FIG. 3 is a front perspective view of the outer pad members of the protective leg gear.
Figure 4:
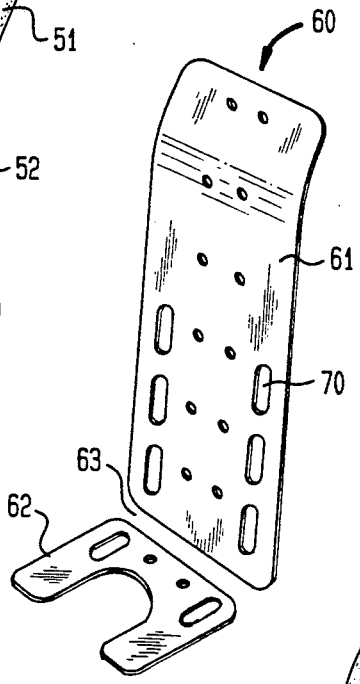
FIG. 4 is a front perspective view of the intermediate member of the protective leg gear.

Turning now to FIGS. 3, 4, and 5, leg gear 40 is shown in its three basic components: outer padding generally designated as 50, intermediate rigid member generally designated as 60, and molded leg pad generally designated as 10. In a preferred embodiment, as shown in FIG. 3, outer padding 50 is formed from thigh padding 51, knee padding 52, shin padding 53, and ankle and foot padding 54, which are each separately provided but can be joined at their adjacent edges by conventional methods of attachment such as being sewn together (preferably before attachment of such padding to the pad member 10). Preferably, padding 51, 52, 53, and 54, which collectively form outer padding 50, are each made from closed cell foam, typically a cross-linked polyethylene, which is provided to absorb shock as well as to control the rebound of a hockey puck or the like. Each section of outer padding 50 is also molded to create a contoured hockey pad front face having several semi-cylindrical rounded cushion portions 55 separated by recessed separation lines 56 therebetween. In one preferred embodiment, knee padding 52 is molded from foam which has been previously laminated with leather or synthetic leather while thigh padding 51, shin padding 53, and ankle and foot padding 54 are each molded from foam previously laminated with a strong material such as Cordura nylon or Clorino.

Referring to FIG. 4, rigid intermediate member 60, provided between outer padding 50 and molded leg pad 10 in the fully assembled leg gear 40, is shown in its preferred embodiment comprising two sections, leg section 61 and foot section 62. It is to be understood, however, that intermediate member can be provided as a single elongate member adapted with the proper bend about the foot and ankle region 63 to conform between outer padding 50 and molded leg pad 10. Both leg section 61 and foot section 62 are preferably formed from a relatively rigid polyethylene material which serves to provide additional support and protection to the fully assembled leg gear 40.

Molded leg pad 10, as depicted in FIG. 5, is shown from a front perspective view to illustrate how leg gear 40 is formed from the three major elements: outer padding 50, intermediate member 60, and molded leg pad 10. Accordingly, molded pad 10 is preferably provided with a relatively flat front face 71 to receive leg section 61 of intermediate member 60 which in turn receives thigh padding 51, knee padding 52, and shin padding 53 of outer padding 50. Likewise, a relatively flat top foot face 72 is provided to receive foot section 62 of intermediate member 60 which in turn receives ankle and foot padding 54 of outer padding 50. In a preferred arrangement, front face 71 and foot face 72 are provided at a relatively sharp angle with respect to one another about traverse line 73, as explained above. As noted earlier, this sharp angle allows for additional comfort to the wearer who will not have to break-in the ankle and foot area 16 (FIG. 1) as is required with typical protective pads.

Figure 6:
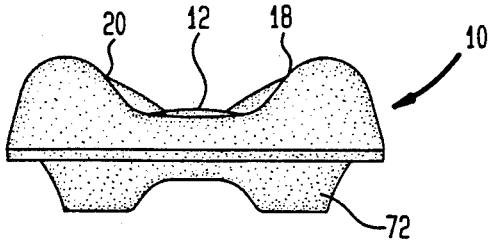
FIG. 6 is a top plan view of the inner pad member shown in FIGS. 1 and 5.

FIG. 6 additionally depicts a top view of molded leg pad 10 in order to better illustrate that it is formed from a single piece of molded material. FIG. 6 accordingly shows elongate groove 12, adjacent side walls 18 and 20, and top foot face 72.

In the preferred attachment arrangement, outer padding 50, intermediate member 60, and molded leg pad 10 are each provided with a series of corresponding strap slots 70 adapted to receive straps 64 (FIG. 2), and which extend from the front to the back of leg gear 40. Straps 64 not only serve to allow leg gear 40 to be attached to the wearer's legs but also assist in securing outer padding 50, intermediate member 60, and molded leg pad 10 to one another.

In the fully formed leg gear 40 shown in FIG. 2, outer padding 50, intermediate member 60, and molded leg pad 10 are all attached via straps 64 and/or other well known attachment means such as sewing. For instance, a nylon or other synthetic covering 41 can be sewn to the components of outer padding 50 (previously covered or laminated in the molding process by nylon or other synthetic coverings 42 or leather covering 43), and molded leg pad 10 can then be enclosed in this covering which is then sewn together at adjacent edges. In a preferred embodiment, a rebound roll 45 is provided to help with puck deflection.

To wear leg gear 40, it is first positioned on the wearer's leg, and then strapped to the leg via straps 64 which typically employ buckles or other known fastening means. When attached to the leg, the wearer's front and side portions of the leg will fit snugly within and against elongate groove 12 and side walls 18 and 20 at thigh area 13, knee area 14, shin area 15, and ankle and foot area 16, providing a comfortable fit without the need for a breaking in period associated with typical protective leg gear.

While the foregoing description and figures illustrate a preferred embodiment of the goal pad and method for making the same in accordance with the present invention, it should be appreciated that certain modifications can be made, and are indeed encouraged to be made, in materials, structure and arrangement of the disclosed embodiments without departing from the spirit and scope of the present invention which is intended to be captured by the claims set forth below.

What is claimed is:

1. A method for making a protective leg pad, comprising the steps of:

a. providing a mold having an elongate and generally semi-cylindrical raised ridge substantially anatomically matching and coextensive with the contour of the front and sides of a full human leg from the knee to the ankle, said mold being constructed and arranged to form a leg pad having a leg portion for covering and protecting the front and sides of the lower portion of a human leg from the knee to the ankle, wherein the mold further comprises an ankle and foot ridge constructed and arranged to form a protective leg pad having an ankle and foot portion which is at a relatively sharp angle with respect to the leg portion, the ankle and foot portion being integral with the leg portion and having an ankle groove coextensive with the leg groove for receiving the ankle and at least a portion of the foot;

b. charging the mold with a synthetic foam material;

c. at least partially curing the material in the mold; and d. removing the at least partially cured material from the mold.

2. The method in claim 1, wherein said synthetic foam material is heat curable, and including the step of at least partially cooling the material in the mold.

3. The method in claim 2 including the step of heating the mold prior to charging the mold with the synthetic foam material.

4. The method in claim 1, wherein the mold includes a knee ridge raised above said semi-cylindrical raised ridge so as to form in the protective leg pad an area for the knee of a human leg.

5. The method in claim 4, wherein the mold further comprises a bend portion constructed and arranged to form a protective leg pad having a slight ben towards the leg groove above the knee of a human leg.

6. The method in claim 5, including the step of inserting slot-forming rod members into the mold and through the synthetic material so as to form strap-receiving slots in the leg portion of the leg pad.

7. The method in claim 1, including the step of forming slots in the leg portion of the leg pad for receiving straps.

8. The method in claim 1, including the step of inserting slot-forming rod members into the mold and through the synthetic material so as to form strap-receiving slots in the leg portion of the leg pad.

* * * * *

UNITED STATES PATENT AND TRADEMARK OFFICE

CERTIFICATE OF CORRECTION

PATENT NO. : 5,328,652

DATED : July 12, 1994

INVENTOR(S) : Thomson

It is certified that error appears in the above-identified patent and that said Letters Patent is hereby corrected as shown below:

In the title, "FOR" should read --OF--.
In the title, "FOAMED" should read --FOAM--.
Column 9, line 11, "ben" should read --bend--.

Signed and Sealed this

Eighth Day of November, 1994

Bruce Lehman

*Attest:*

BRUCE LEHMAN

*Attesting Officer*

*Commissioner of Patents and Trademarks*